United States Patent [19]

Fingerson et al.

[11] Patent Number: 4,874,180

[45] Date of Patent: Oct. 17, 1989

[54] ARROW SHAFT END ADAPTOR APPARATUS AND BALANCE PIN APPARATUS AND METHOD

[75] Inventors: Conrad F. Fingerson, Chatfield; Dennis L. Carlson, Brooklyn Park; Bruce A. Nelson, Chatfield; Robert D. Eickhoff, Fountain, all of Minn.

[73] Assignee: AFC, Inc., Chatfield, Minn.

[21] Appl. No.: 102,028

[22] Filed: Sep. 29, 1987

[51] Int. Cl.[4] ..... F41B 5/02

[52] U.S. Cl. ..... 273/416

[58] Field of Search ..... 273/416, 418–423

[56] References Cited

U.S. PATENT DOCUMENTS

| | | | |
|---|---|---|---|
| 213,083 | 3/1879 | Wright et al. | 273/420 X |
| 2,289,284 | 7/1942 | Chandler | 273/421 |
| 2,568,417 | 9/1951 | Steinbacher | 273/421 |
| 2,613,936 | 10/1952 | Dalton | 273/419 |
| 2,694,661 | 11/1954 | Meyer | 273/416 X |
| 2,806,317 | 9/1957 | Minisini | 273/421 X |
| 2,940,758 | 6/1960 | Richter | 273/422 |
| 3,036,395 | 5/1962 | Nelson | 273/421 |
| 3,425,695 | 2/1969 | Kestenbaum | 273/419 |
| 3,614,103 | 10/1971 | Carroll | 273/422 |
| 3,868,114 | 2/1975 | Groner | 273/419 |
| 3,910,579 | 10/1975 | Sprandel | 273/422 |
| 4,050,696 | 9/1977 | Troncoso, Jr. | 273/420 |
| 4,166,619 | 9/1979 | Bergmann et al. | 273/418 |
| 4,210,330 | 7/1980 | Kosbab | 273/422 |
| 4,533,146 | 8/1985 | Schaar | 273/422 |
| 4,615,529 | 10/1986 | Vocal | 273/421 |
| 4,645,211 | 2/1987 | Beiter | 273/416 |

FOREIGN PATENT DOCUMENTS

| | | | |
|---|---|---|---|
| 644226 | 10/1950 | United Kingdom | 273/416 |

OTHER PUBLICATIONS

Bow & Arrow, 10/1983, p. 12.

Bow & Arrow Hunting 10/1985, p. 75, Precision Arrow Attachments.

*Primary Examiner*—Paul E. Shapiro

[57] ABSTRACT

An arrow end adaptor and a balance pin for an arrow and a method for making the same. The arrow comprising a ferrule having a large enough inner diameter to be placed over the arrow shaft, and further having an exterior threaded end whose diameter is smaller than the diameter of the arrow shaft. The point cap is designed such that an arrow point having interior threads may be attached to the exterior threaded end of the point cap. The balance pin is designed to have a head at one end that may be affixed to either a target point or a point cap and a shaft end that may be inserted into the arrow shaft.

2 Claims, 2 Drawing Sheets

ARROW SHAFT END ADAPTOR APPARATUS AND BALANCE PIN APPARATUS AND METHOD

BACKGROUND OF THE INVENTION

This invention relates to archery equipment and particularly to apparatus and methods for attaching arrow points and nocks to arrow shafts and for balancing arrow shafts.

The end adaptor apparatus and balance pin apparatus of the present invention are an improvement over prior art. For example, as known in the prior art, arrow points have a large externally threaded end and are screwed into an arrow shaft having an internal thread. Shortcomings of the prior art are that the shaft's internal threads cause stress to be exerted on the wall of the shaft. Hollow tubes made primarily of unidirectional fibers running the length direction and bonded together with a plastic resin or matrix are prone to split if stressed from the inside and, in particular, if stressed at the end of a tube. A further shortcoming is that when the arrow point is removed, dirt may easily enter the shaft of internal threads through the unsealed end. This affects the weight and balance of the arrow, making it less desirable to use.

The present invention solves these and other problems associated with the prior art.

SUMMARY OF THE INVENTION

It is therefore an object of this invention to provide a small lightweight point cap system that may be adjustable in weight so that perfect balance is easily obtained. In one embodiment, the point cap system comprises a point cap and a balance pin which can be varied in size so as to be of adjustable weight.

The present invention provides a point cap system which is small and lightweight and greatly reduces the material and weight of the point or broadhead that may be attached. Light and slim graphite arrows perform and look best with smaller and lighter points than the industry standards.

The present invention also relates to a balance pin whose weight can be adjusted to balance an arrow shaft.

Further, the present invention provides a point cap and balance pin design which works together. When the balance pin is used (and trimmed to the desired length), the exact point weight may be obtained giving the arrow perfect balance.

Also, the present invention relates to means to attach points to arrow shafts without allowing dirt to be able to enter the shaft when the arrow points are not attached.

This invention further attempts to have the threads receiving the arrow point placed on a point cap member such that if the threads are damaged, the point cap member may be replaced with a new threaded point cap member. Thus, the more expensive arrow shaft is not rendered useless.

The invention also relates to a means of attachment that is suited to the use of unidirectional fiber reinforced shafts. This invention utilizes the strength of the reinforcing fibers by reducing the cross fiber stress at the end of the shaft.

The present invention also relates to means for uniformly encapsulating or capping the end of an arrow shaft with a material that has nearly the same strength properties in all directions like steel or aluminum.

One embodiment of the present invention also relates to a point adaptor adhesively attached to the arrow shaft and having internal threads for threaded receipt of various types of arrow points having external threads.

The present invention also relates to a nock cap adaptor for attaching nocks to the end of an arrow shaft.

These and various other advantages and features of novelty which characterize the invention are pointed out with particularity in the claims annexed hereto and forming a part hereof. However, for a better understanding of the invention, its advantages, and its objects obtained by its use, reference should be made to the drawings which form a further part hereof, and to the accompanying description matter, in which there is illustrated and described a preferred embodiment of the invention.

BRIEF DISCUSSION OF THE DRAWINGS

In the drawings, wherein like reference numerals indicate corresponding parts throughout;

DESCRIPTION OF THE PREFERRED EMBODIMENT

Figure 1:
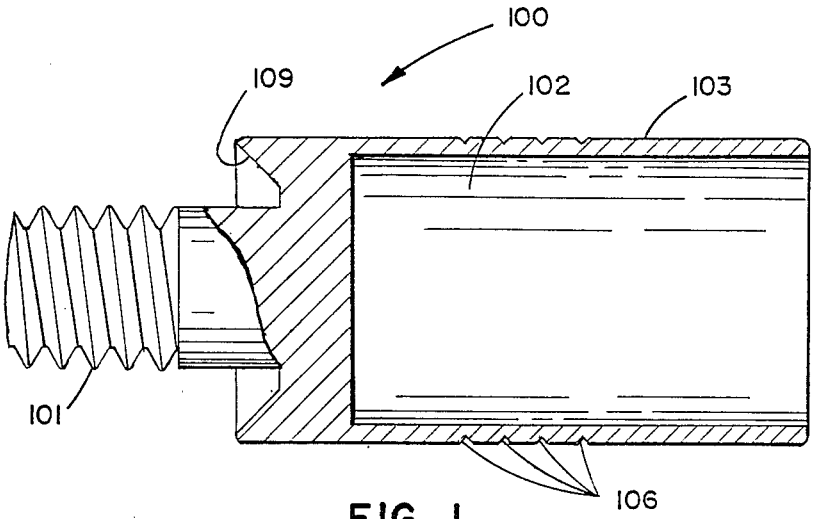
FIG. 1 is an enlarged sectional view of one embodiment of a point cap in accordance with the principles of the present invention.
Figure 2:
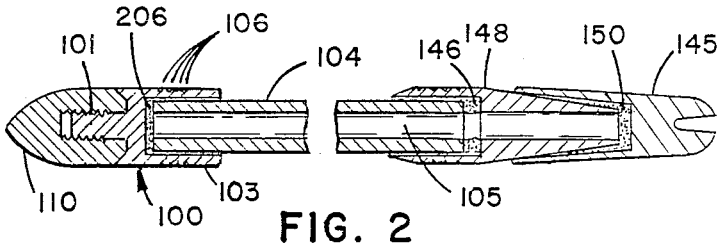
FIG. 2 is a sectional view illustrating attachment of a field point to an arrow shaft by use of the point cap in accordance with the principles of the present invention.

Referring to the drawings, where like numerals apply to like parts, and more particularly to FIG. 1, an embodiment of an end adaptor, herein referred to as a point cap, 100 may be seen. The point cap 100 is an integral, one-piece unit which includes an externally threaded end 101, to which an arrow point, such as a target point, a field point, or a broadhead point, with cooperating internal threads may be secured as generally indicated in FIG. 2, wherein a field point 110 is shown attached to an arrow shaft 104 via the point cap 100. In the preferred embodiment, the point cap 100 is made from a hardened steel.

An opposite end portion 103, also referred to as a ferrule end, of the point cap 100 forms a cylinder with a hollow interior 102. Hollow interior 102 has a diameter such that the point cap slides over and is suitably affixed to the arrow shaft 104. The arrow shaft 104 shown in FIG. 2 is hollow and has a bore 105. In the preferred embodiment, the arrow shaft is made of graphite, glass or similar unidirectional reinforcing fibers. The point cap 100 may be affixed to the arrow shaft using an epoxy. The point cap 100 might include identification grooves 106 for identifying varying configurations of point cap as may be used with varied sizes and configurations of arrow points, shafts, etc. The use of an externally attached point cap provides additional support to the end of the arrow shaft. The terminology ferrule, as used herein, refers to a bore with surrounding cylindrical wall portion providing additional support to the shaft it cooperates with.

As opposed to internal threads for arrow point attachment, the use of external threads at the end of a cap is ideal for graphite shafts because stress is reduced at the end of the shaft.

Preferably, the point cap is permanently attached to the arrow shaft; however, in some embodiments the point cap might be attached with a less permanent adhesive such that if the threads are damaged, the point cap may be replaced with a relatively inexpensive new point cap, thereby preventing the loss of the more expensive arrow. In the preferred embodiment, the threaded end 101 has a lesser outside diameter than the outside diameter of the end portion 103 and the outside diameter of the arrow shaft 104. At the junction of the threaded end 101 and the end portion 103, the end portion 103 is circumferentially surrounded by an inclined surface 109 for cooperating with a similarly inclined surface of an arrow point.

Figure 3:
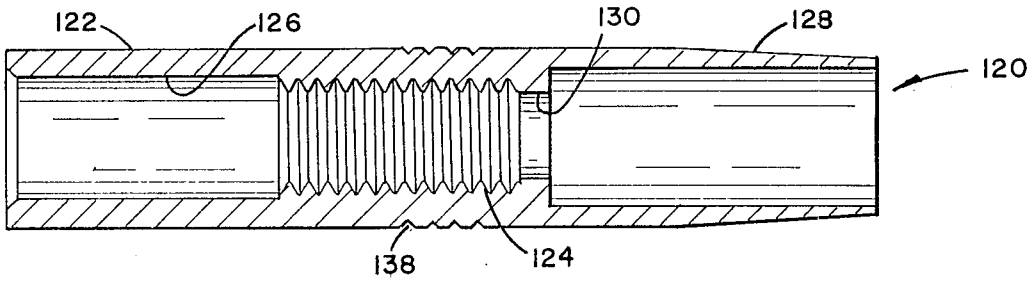
FIG. 3 is an enlarged sectional view of one embodiment of a point adaptor in accordance with the principles of the present invention.
Figure 4:
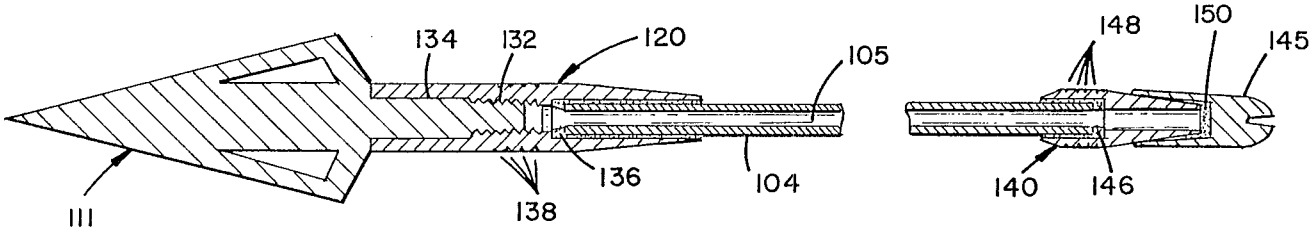
FIG. 4 is a sectional view illustrating attachment of a broadhead to an arrow shaft by use of the point adaptor shown in FIG. 3.

Illustrated in FIG. 3 is an embodiment of an internally threaded point adaptor 120 in accordance with the principles of the present invention. The point adaptor 120 is an integral, one-piece unit which includes a first end 122 including an internally threaded portion 124 and a hollow cylindrical bore portion 126. A second end 128 has an externally tapered surface and a bore configured for receipt of the arrow shaft 104, as generally illustrated in FIG. 4. The first and second ends 122,128 are interconnected by a passageway 130 to allow the escape of air upon insertion of the arrow shaft 104 into the bore of the second end 128. In FIG. 4, a broadhead arrow point 111 is illustrated as being threaded into the threaded portion 124, a threaded portion 132 of the broadhead arrow point cooperating with the threaded portion 124 of the point adaptor 120. The broadhead arrow point 111 is shown further including a cylindrical portion 134 slidably received in the bore portion 126 of the point adaptor 120. The point adaptor 120 is preferably made of a light material such as aluminum. As illustrated in FIG. 4, the point adaptor 120 is preferably attached to the arrow shaft 104 by an adhesive 136 such as epoxy. In FIG. 4, the arrow shaft 104 is illustrated as being hollow, although it will be appreciated that the arrow shaft might also be solid. The point adaptor 120 might further include identifying grooves 138 for identifying differing configurations and sizes of the point adaptor 120.

Figure 5:
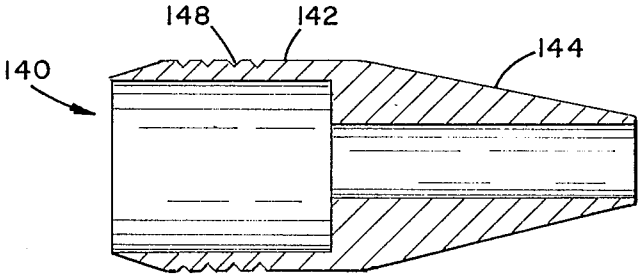
FIG. 5 is an enlarged sectional view of one embodiment of a nock cap in accordance with the principles of the present invention.

Illustrated in FIG. 5 is an embodiment of a nock cap 140 in accordance with the principles of the present invention. The nock cap 140 includes a first hollow cylindrical end 142 for slidable receipt on the arrow shaft 104 and a hollow tapered end 144 for insertion into a bore of a nock 145, as generally illustrated in FIG. 4. The nock cap 140 provides fluid communication between its ends such that upon insertion of the nock cap 140 onto an end of the arrow shaft 104, air can escape from the nock cap 140. The nock cap 140 is preferably made of a light material such as aluminum and is attached to the arrow shaft by an adhesive 146. The nock cap 140 might further include identifying grooves 148 as in the case of the point adaptor 120. The nock 145 is preferably made of a light material such as plastic and is attached to the nock cap 140 by an adhesive 150.

Figure 6:
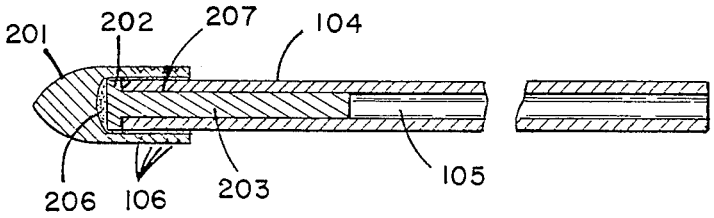
FIG. 6 is a sectional view of one embodiment of a balance pin attached to an arrow point and inserted into an arrow shaft in accordance with the principles of the present invention.

FIG. 6 refers to a balance pin 207 which may be used with an arrow point such as a target point 201. The balance pin 207 is affixed to the arrow shaft 104 by insertion into the arrow shaft 104 without necessitating the use of a threaded arrow shaft. A head portion 202 of the balance pin 207 is bonded to the interior of the arrow point 201 by adhesive 206. A shaft portion 203 of the balance pin 207 is inserted into the bore 105, of the arrow shaft 104. Preferably, the balance pin 207 is made of a heavy, soft metal such as brass, such that the balance pin shaft 203 may be cut off or trimmed to obtain a desired point weight. In the preferred embodiment, the balance pin 207 is an integral, one-piece unit. The balance pin 207 may also be used with a point cap by binding the balance pin to the interior of the point cap 100. In this way, it is possible to adjust the point weight.

The point cap 100 is used with an arrow shaft by suitably affixing the ferrule end 103 of the point cap 100 to the arrow shaft 104. An arrow point, such as a target point or broad head may be then threadedly attached to the point cap.

The balance pin 207 may be used with an arrow point having a hollow interior by affixing the head portion 202 of the balance pin 207 to the hollow interior of field point 201 by placement of an adhesive between the head portion of the balance pin and the arrow point or point cap. The shaft 203 of the balance pin is then inserted into the arrow shaft bore 105. To prevent movement or vibration of the end cap in the arrow shaft, a small amount of adhesive might be placed on the shaft of the balance pin.

Figure 7:
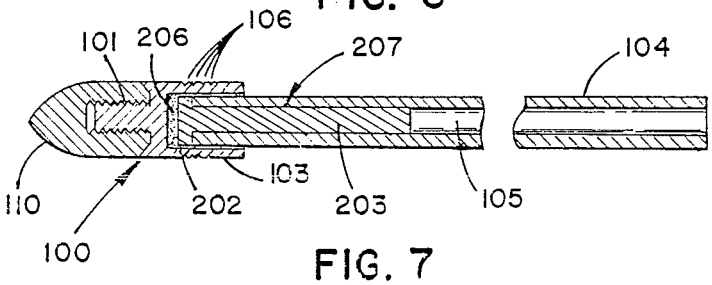
FIG. 7 is a sectional view illustrating an embodiment of an arrow shaft including the point cap and the balance pin.

As illustrated in FIG. 7, the balance pin 207 may be used with the point cap 100 by suitably affixing the head portion 202 of balance pin 207 in the bore 102 of the ferrule end 103 of the point cap 100. The point cap 100 is then attached to the arrow shaft 104 such that the balance pin shaft 203 is in the interior of the arrow shaft 104.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A single piece end adaptor for attachment to a hollow circular arrow shaft, said arrow shaft having a first end and a second end and an opening with an inner surface defined therethrough, said single piece end adaptor comprising;

a cylindrical body having a ferrule end and an externally threaded end, and ferrule end having an outer diameter and a cylindrical bore with a continuous inner surface defined upwardly therein, the inner surface of said bore adhesively engageable about a portion of the first end of the circular arrow shaft;

said externally threaded end opposite said ferrule end having constant pitch and constant diameter external threads defined thereabout, and an inclined surface defined in a circular manner about the intersection of said ferrule end and said externally threaded end, said inclined surface tapered inward from said outer diameter of said ferrule end towards said bore of said ferrule end, said inclined surface having an inner diameter greater than the diameter of the constant diameter external threads, said external threads and said inclined surface formed to threadedly receive and retain an arrow point with cooperating constant pitch and constant diameter internal threads and inclined surface so that impact forces from the arrow point are not transmitted to the inner surface of said circular arrow shaft.

2. A method of making an arrow comprising the steps of:

providing a hollow circular shaft having a first end and a second end and opening with an inner surface defined therethrough, providing a single piece end adaptor having;

a ferrule end with an outer diameter and a cylindrical bore with a continuous inner surface defined upwardly therein, the inner surface of said bore adhesively engagable about a portion of the first end of said hollow circular shaft; and an externally threaded end opposite said ferrule end, said externally threaded end having;

constant pitch and constant diameter external threads defined thereabout, and an inclined surface defined in a circular manner about the intersection of said ferrule end and said externally threaded end, said inclined surface tapered inward from said outer diameter of said ferrule end towards said bore of said ferrule end, said inclined surface having an inner diameter greater than the diameter of the constant diameter external threads, said external threads and said inclined surface formed to threadedly receive and retain an arrow point with cooperating constant pitch and constant diameter internal threads and inclined surface so that impact forces from the arrow point are not transmitted to the inner surface of said circular shaft.

adhesively engaging a portion of said inner surface of said bore of said ferrule end to the first end of said hollow circular shaft, threading an arrow point on the externally threaded end of said end adaptor, and contacting said inclined surface of said arrow point with said inclined surface of said externally threaded end.

* * * * *